US007413610B2

(12) United States Patent
Mielke

(10) Patent No.: US 7,413,610 B2
(45) Date of Patent: Aug. 19, 2008

(54) METHOD AND APPARATUS FOR COATING OR HEAT TREATMENT OF BLISKS FOR AIRCRAFT GAS TURBINES

(75) Inventor: Rainer Mielke, Oberursel (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 220 days.

(21) Appl. No.: 10/998,153

(22) Filed: Nov. 29, 2004

(65) Prior Publication Data

US 2005/0271512 A1 Dec. 8, 2005

(30) Foreign Application Priority Data

Nov. 28, 2003 (DE) ..... 103 56 679

(51) Int. Cl.

| | |
|---|---|
| ***C23C 16/00*** | (2006.01) |
| ***C23C 16/04*** | (2006.01) |
| ***C23C 16/46*** | (2006.01) |
| ***C23C 16/458*** | (2006.01) |
| *C23C 16/06* | (2006.01) |

(52) U.S. Cl. ..... 118/724; 118/715; 118/720; 118/721; 118/728; 118/500; 118/503; 118/504; 118/505

(58) Field of Classification Search ..... 416/234
See application file for complete search history.

(56) References Cited

U.S. PATENT DOCUMENTS

| | | | | |
|---|---|---|---|---|
| 3,241,519 | A | 3/1966 | Lloyd | |
| 3,683,847 | A | 8/1972 | Carleton | |
| 3,849,022 | A * | 11/1974 | Amann et al. | 415/116 |
| 3,928,963 | A * | 12/1975 | Devers et al. | 60/806 |
| 4,136,516 | A * | 1/1979 | Corsmeier | 60/39.091 |
| 4,851,188 | A | 7/1989 | Schaefer | |
| 5,317,877 | A * | 6/1994 | Stuart | 60/736 |
| 5,417,567 | A * | 5/1995 | Peter | 432/205 |
| 6,172,327 | B1 | 1/2001 | Aleshin | |
| 6,244,492 | B1 | 6/2001 | Kupetz | |
| 6,588,484 | B1 * | 7/2003 | Fosaaen et al. | 164/28 |
| 2002/0157739 | A1 * | 10/2002 | Fisher et al. | 148/567 |

FOREIGN PATENT DOCUMENTS

| | | | |
|---|---|---|---|
| DE | 9301293 | U1 | 1/1993 |
| DE | 19919054 | A1 | 11/2000 |
| EP | 0 525 975 | A1 | 2/1992 |
| EP | 1253289 | A2 | 10/2002 |
| EP | 1253289 | A3 | 10/2002 |
| EP | 1253289 | B1 | 1/2006 |
| WO | WO01/04375 | A1 | 1/2001 |

* cited by examiner

*Primary Examiner*—Jeffrie Lund
(74) *Attorney, Agent, or Firm*—Timothy J. Klima

(57) ABSTRACT

A method for hard-material coating or heat treatment of the blade airfoils of blisks for gas turbines provides for partial heat-insulation and cooling of the other blisk parts during the respective process to prevent their properties from being changed by the high temperatures. The apparatus required for this method comprises two or more cooling plates (5 to 7) which are thermally insulated on their outer surfaces and include supporting flanges (20) which heat-conductively locate the blade platforms (3) of the blisks (1). Radially extending cooling medium channels (16) are provided in the cooling plates connected to a cooling medium source to continually apply cooling medium to the inner surfaces of the supporting flanges and the blade platforms.

15 Claims, 2 Drawing Sheets

METHOD AND APPARATUS FOR COATING OR HEAT TREATMENT OF BLISKS FOR AIRCRAFT GAS TURBINES

This application claims priority to German Patent Application DE10356679 filed Nov. 28, 2003, the entirety of which is incorporated by reference herein.

BACKGROUND OF THE INVENTION

This invention relates to a method for elevated-temperature hard-material coating or heat treatment of the blade airfoils of blisks of aircraft gas turbines and an apparatus for the performance of this method.

High-pressure compressors of aircraft turbines can be equipped with blisks where the actual disk, the blade platforms and the blade airfoils are manufactured as one integral part. In order to improve protection against wear by particles carried by the compressed air, the blade airfoils, as is generally known, are coated, for example, by means of an elevated-temperature plasma vapor deposition process using hard materials, such as nitrides or carbides. Further, after repair of the blade airfoils, the blisks are subject to a heat-treatment process. The coating or the heat-treatment processes, respectively, are, however, disadvantageous in that, simultaneously with the blade airfoils, the blade platforms and the actual disk are heated to a temperature that exceeds the maximum operating temperature. While this high process temperature does not constitute a serious problem for the less loaded stressed blade airfoils, it can cause geometrical distortion, affect serviceability and, ultimately, lead to a reduction of service life of the other parts of the blisk.

BRIEF SUMMARY OF THE INVENTION

This invention, in a broad aspect, provides a coating or heat treatment method, and an apparatus for the performance of this method, which enable the blade airfoils to be repaired and heat-treated or coated many times, without affecting the service life of the blisk as a whole.

It is a particular object of the present invention to provide solution to the above problems by a method and an apparatus for the performance of this method in accordance with the features described herein. Further advantageous embodiments of the present invention will be apparent from the present description.

According to the method proposed, exposure to the high temperatures occurring during elevated-temperature hard-material coating or heat treatment of blade airfoils is confined to the blade airfoils, while the other parts of the blisk are insulated against the hot environment and are partially cooled by heat transfer to a solid medium and a fluidic cooling medium, as a result of which they will not exceed the maximum operating temperature. In other words, the idea underlying the present invention is to heat-treat/coat one part of the blisk while cooling and insulating the other. Thus, the operationally highly loaded disk remains fully serviceable and attains a long service life even after multiple heat treatments or coatings. Furthermore, the serviceability of the less loaded blade airfoils is not affected by the influence of heat. The possibility of hard-material coating or heat treatment of repaired blade airfoils so created ensures the longevity of the blisks.

The cooling apparatus for the performance of the above method comprises two or more cooling plates which are heat-insulated at the outer surfaces, actually a bottom cooling plate and a top cooling plate and, if more than one blisk is to be treated, at least one intermediate cooling plate. The cooling plates feature peripheral supporting flanges whose front faces interact with the front faces of the blade platform and serve as solid cooling medium by virtue of heat transfer from the blade platform to the supporting flange. Cooling is further effected by means of a fluidic cooling medium supplied via cooling medium channels provided in the cooling plates, this cooling medium cooling both the inner faces of the supporting flanges of the cooling plates and the inner faces of the blade platform. Summarizing, then, the blade airfoils of the blisks are subject to the high temperature required for post-repair heat treatment or hard-material deposition, while the temperature of the other parts of the blisk can be kept so low that the properties of the blisk and, thus, its serviceability and service life, are not affected.

In a development of the present invention, a cooling plate comprises an inner annular channel by which the cooling fluid is supplied and an outer annular channel which is connected to the inner annular channel via cooling medium channels and to which swirler nozzles are connected. By means of the swirler nozzles, the cooling fluid can be directly applied to the inner surfaces of the supporting flanges and of the blade platforms. Where the cooling plate is used as intermediate cooling plate between two adjacent blisks, the swirler nozzles are also oriented in the opposite direction to enable the cooling fluid to be applied to both supporting flanges and to both blade platforms.

In a further development of the present invention, a volume control device is arranged upstream of the cooling medium channels, this volume control device preferably comprising two adjacent setting rings with slotted ports. The degree of overlap of the slotted ports controls the cooling medium volume supplied to the supporting flange and to the blade platform, respectively.

The cooling plates are thermally insulated against the hot hard-material coating or heat-treatment atmosphere by heat shields attached to outer surfaces of the cooling plates.

In an advantageous further development of the present invention, heat shields are also attached to certain inner surfaces of the cooling plates which are in contact with the heated cooling fluid. The retainers for these heat shields are provided with guiding elements which remove the heated fluid from the heat shields.

BRIEF DESCRIPTION OF THE DRAWINGS

An embodiment of the present invention is more fully described in light of the accompanying drawings. In the drawings.

DETAILED DESCRIPTION OF THE INVENTION

Figure 1:
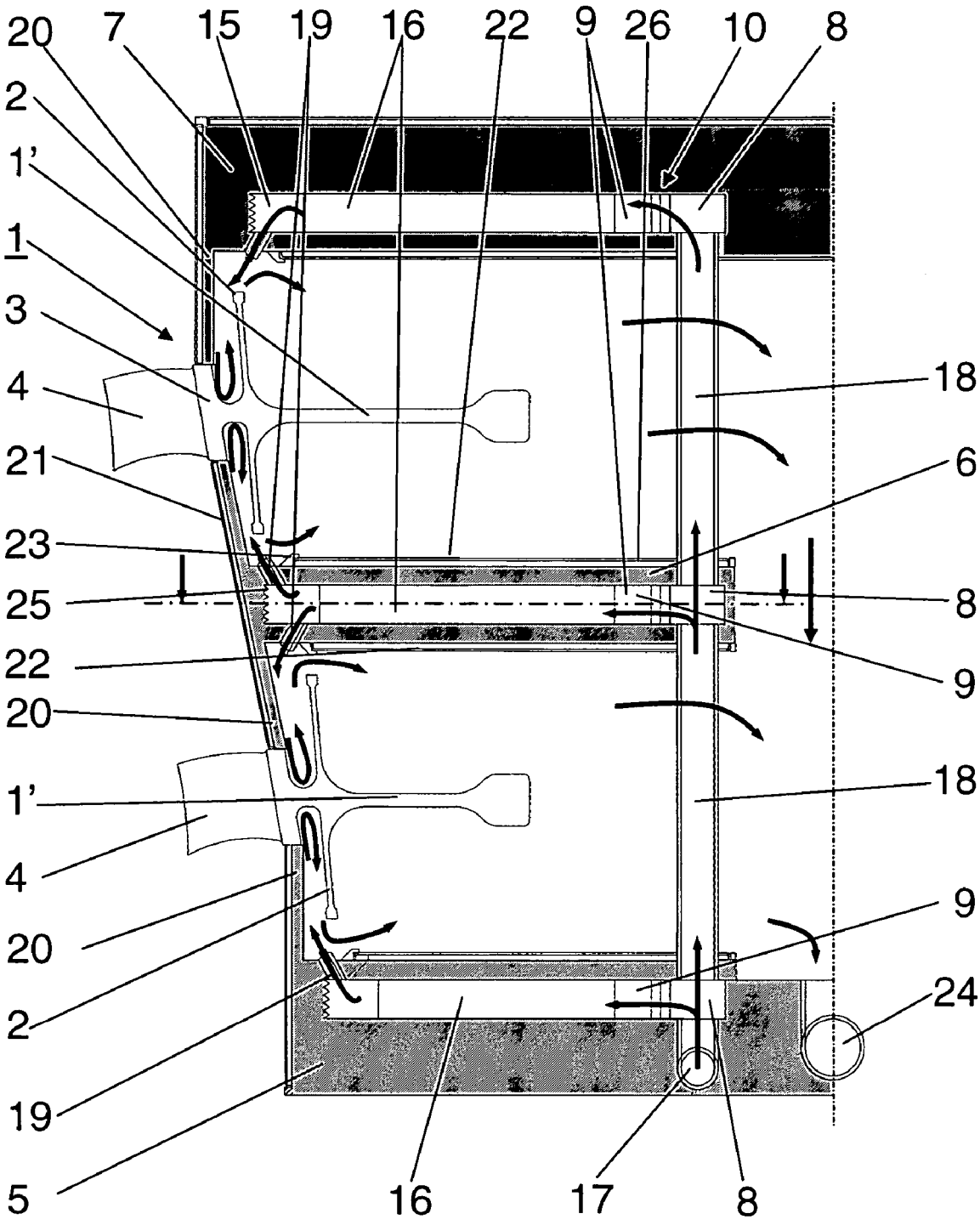
FIG. 1 is a partial sectional view of a cooling apparatus for two blisks of the high-pressure compressor of an aircraft gas turbine.
Figure 2:
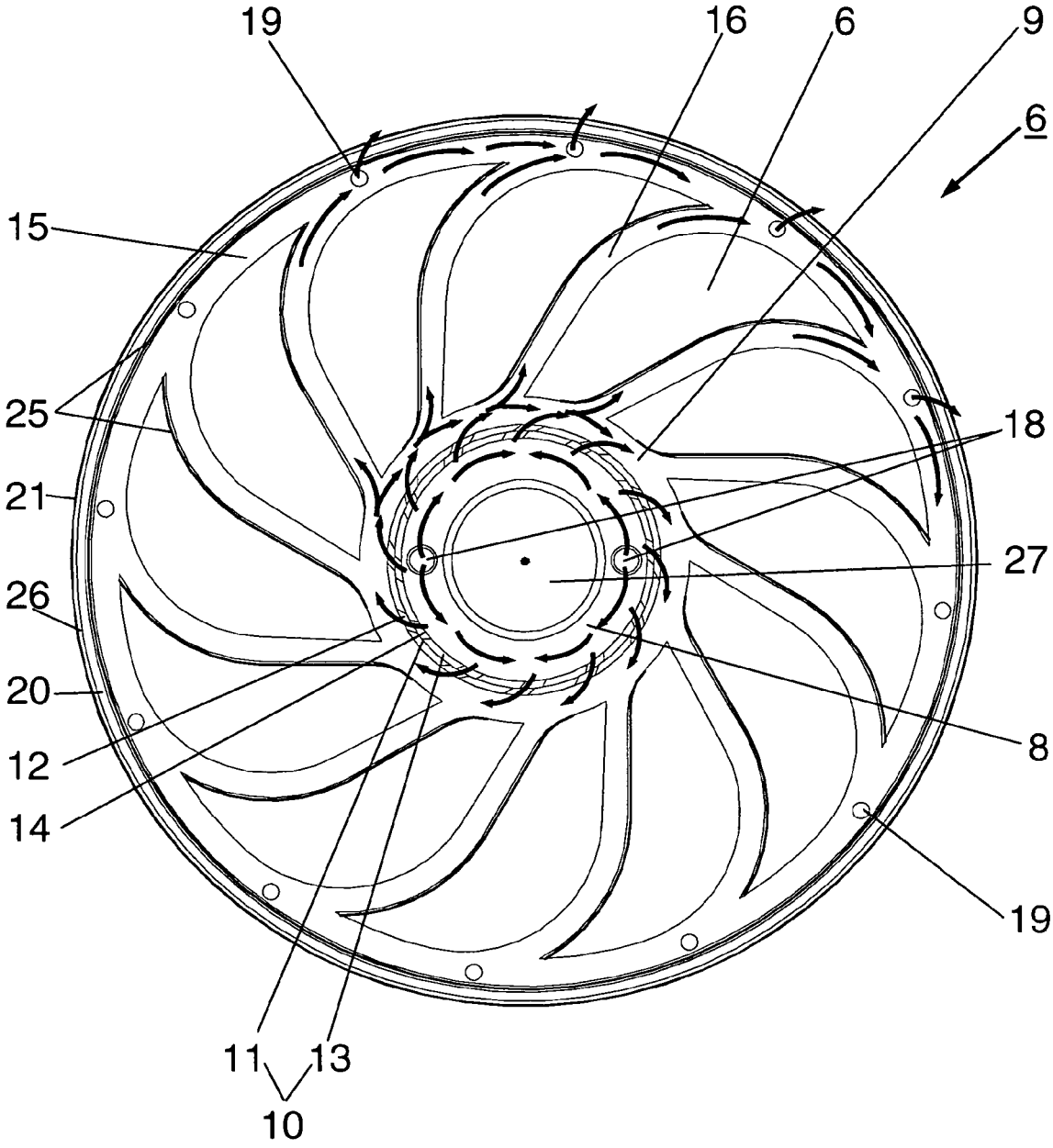
FIG. 2 shows a longitudinal section of an intermediate cooling plate of the cooling apparatus according to FIG. 1 arranged between two blisks.

A one-piece blisk 1 for the compressor of an aircraft gas turbine comprises a disk 1' with connecting arms 2 and a blade platform 3 with integral blade airfoils 4. For wear-protection coating of the blade airfoils 4 with carbides or nitrides or for heat treatment subsequent to blade repair, only the blade airfoils 4 are exposed to the temperature required for furnace heat treatment or vapor deposition, while the uncoated parts of the blisk 1 are heated to a temperature which does exceed the normal operating temperature of the aircraft gas turbine, but not a max. acceptable temperature of 320° C. or 350° C., as appropriate for the respective titanium alloy used, for example Ti64 or Ti6246. For this purpose, the blisks 1, with the exception of the blade airfoils 4, are accommodated or held in the cooling apparatus described in the following.

The cooling apparatus, shown here by way of example of two blisks to be heat-treated, comprises three cooling plates 5 to 7, actually a bottom cooling plate 5, a top cooling plate 7 and an intermediate cooling plate 6 arranged between the two blisks 1. For more than two blisks 1, the number of intermediate cooling plates 6 is correspondingly higher. The intermediate cooling plates feature a centric passage 27. Each of the three cooling pates 5 to 7 comprises an inner annular channel 8 and an intermediate annular channel 9 which are connected to each other by means of a volume control device 10 for control of the cooling medium flow. The volume control device 10 includes a first setting ring 11 with slotted ports 12 and a second setting ring 13 with slotted ports 14. The control of the cooling medium volumes required for the blisks 1 arranged at different levels in a cooling apparatus is effected by adjustment of the setting rings 11 and 13 relative to each other, thus varying the overlap of the slotted ports 12 and 14.

Furthermore, the cooling plates 5 to 7 feature an outer annular channel 15. The intermediate annular channel 9 is connected to the outer annular channel 15 via radial cooling medium channels 16 originating at the periphery of the intermediate annular channel 9. The curved cooling medium channels 16 issue tangentially into the outer annular channel 15. The inner annular channel 8 provided in the bottom cooling plate 5 is connected to a cooling medium connection 17 provided in the bottom cooling plate 5, and the inner annular channel 8 of the intermediate cooling plate 6 is connected to the inner annular channels 8 of both, the bottom cooling plate 5 and the top cooling plate 7 by means of a medium supply line 18 each. Obliquely arranged swirler nozzles 19 are provided in the area of entrance of the cooling medium channels 16 into the outer annular channel 15. On the intermediate cooling plate 6, the swirler nozzles 19 extend from both sides of the outer annular channel 15.

The blisks 1 are held at the front face of their blade platform 3 between supporting flanges 20, provided on one side of the bottom cooling plate 5 and the top cooling plate 7, and protruding from both sides of the intermediate cooling plate 6. The supporting flanges 20 are in intimate, heat-conducting contact with the blade platform 3 to dissipate as much heat as possible from the blade platform 3. In order to increase the cooling effect of the cooling medium at the three cooling plates 5 to 7, a surface texture 25 is provided on the circumferential outer wall of the outer annular channels 15 and on the pressure-side outer wall of the swirler channels 16 to increase the cooling surface area. In addition, heat shields 21 are provided on the outer surfaces of the cooling plates 5 to 7, i.e. on the outer sides of the supporting flanges 20 and the top side of the top cooling plate 7, to avoid, or minimize, the transfer of heat from the outside to the cooling plates 5 to 7. Further heat shields 22 are provided on the parallel, opposite inner surfaces of the cooling plates 5 to 7. The heat shields 21, 22 can be lined with a heat-insulating material 26 on the inner side. The heat shields 22 are attached with retainers 23 which are designed such that the heated cooling medium is carried away from the heat shield 22. A cooling medium outlet 24 is provided in the bottom cooling plate 5.

The Operation of the Cooling Apparatus Described Above is as Follows:

In a plasma vapor deposition cabinet, the first blisk 1, followed by the intermediate cooling plate 6, is placed on the bottom cooling plate 5 connected via the cooling medium connection 17 to a cooling medium source (not shown). Subsequently, the second blisk 1 is placed on the intermediate cooling plate 6. The upper termination of this arrangement is the top cooling plate 7. With the cooling apparatus set up in the above manner, the connection between the inner annular channels 8 of the three cooling plates 5 to 7 is made via the medium supply line 18. Accordingly, the blade airfoils 4 of the two blisks 1 are exposed in the plasma vapour deposition cabinet, while the remaining parts of the blisk, with the exception of the outer surface of the blade platform 3 adjoining the blade airfoils 4, lie within the space enclosed by the cooling plates 5 to 7 and insulated by outer heat shields 21.

The cooling medium flows via the cooling medium connection 17 and the medium supply lines 18 into the inner annular channel 8 of the bottom cooling plate 5, the intermediate cooling plate 6 and the top cooling plate 7. From the inner annular channel 8, the cooling medium flows via the volume control device 10, i.e. the slotted ports 12 and 14 in the adjustable setting rings 11, 13, to the respective intermediate annular channel 9 and from there into the cooling medium channels 16 to finally reach the respective outer annular channels 15 of the three cooling plates 5 to 7. The cooling medium exiting from the swirler nozzles 19 flows along the supporting flanges 20 of the cooling plates and the blade platform 3 as well as the connecting arms 2 of the blisk 1 and gets via the guiding-element type retainers 23 for the inner heat shields 22 into the space between each two adjacent cooling plates 5 and 6 and 6 and 7, respectively. The heated cooling medium finally flows via the cooling medium outlet 24 to the outside. It can be cooled by means of heat exchangers (not shown) and returned to the cooling process. The blade platform 3, which is subject to very high thermal load since it is closest to the blade airfoils 4, is cooled both, by heat-conducting contact with the intensely cooled supporting flanges 20 and directly by the cooling medium flow. Thus, with the exception of the blade airfoils, the maximum operating temperature of the blisk material is not exceeded and, in consequence, a long service life of the blisk is attained, even if the blade airfoils are subject to multiple thermal treatments necessitated by repair or hard-material coating.

List of Reference Numerals

1 Blisk
1' Disk
2 Connecting arms
3 Blade platform
4 Blade airfoil
5 Bottom cooling plate (cooling plate)
6 Intermediate cooling plate (cooling plate)
7 Top cooling plate (cooling plate)
8 Inner annular channel
9 Intermediate annular channel
10 Volume control device
11 First setting ring
12 Slotted port
13 Second setting ring
14 Slotted port
15 Outer annular channel
16 Cooling medium channels
17 Cooling medium connection
18 Medium supply line
19 Swirler nozzles
20 Supporting flange
21 Heat shield, outside
22 Heat shield, inside

23 Retainer (guiding element)
24 Cooling medium outlet
25 Surface texture
26 Insulating material of 21/22
27 Passage of 6

What is claimed is:

1. An apparatus for elevated-temperature hard-material coating/heat treatment of blade airfoils of a blisk for a gas turbine, comprising:

at least two axially separable and joinable cooling plates that, when axially joined, form at least one internal cooling chamber that encloses, isolates and insulates portions of the blisk against a furnace atmosphere, while simultaneously exposing the blade airfoils to the furnace atmosphere for the elevated-temperature coating/heat treatment, the cooling plates including insulated outer surfaces, the cooling plates also including supporting flanges for heat-conductively locating front faces of blade platforms of the blisk, the cooling plates further including radial cooling medium channels connected to a cooling medium source to supply a flow of cooling medium to the at least one internal cooling chamber for direct contact with and cooling of surfaces of the supporting flanges and the blade platforms exposed within the at least one internal cooling chamber.

2. An apparatus in accordance with claim 1, wherein the cooling plates comprise a bottom cooling plate and a top cooling plate, each with a supporting flange extending around an outer circumference thereof and at least one intermediate cooling plate with two supporting flanges, each provided on an outer circumference thereof and facing in opposite directions, the cooling plates constructed and arranged to enclose a first blisk between the top cooling plate and the intermediate cooling plate and to also enclose a second blisk between the bottom cooling plate and the intermediate plate.

3. An apparatus in accordance with claim 2, wherein the bottom cooling plate includes a cooling medium connection for inputting cooling medium and a cooling medium outlet for removing cooling medium.

4. An apparatus in accordance with claim 2, wherein the cooling plates comprise: an inner annular channel connected to a medium supply line, an intermediate annular channel, a volume control device positioned between the inner annular channel, an outer annular channel extending around an outer circumference of the cooling plates and curved swirler cooling medium channels connecting the intermediate annular channel and the outer annular channel extending on the outer circumference of the cooling plates.

5. An apparatus in accordance with claim 4, comprising, circumferentially distributed swirler nozzles connected to the outer annular channel to direct cooling medium to the supporting flanges and the blade platforms.

6. An apparatus in accordance with claim 4, wherein the volume control device comprises a first and a second setting ring, each provided with overlappable slotted ports such that the volume of cooling medium flow between the inner annular channel and the intermediate annular channel is controlled by the amount of overlap of the slotted ports.

7. An apparatus in accordance with claim 4, wherein the outer annular channel includes a surface texture on its radial circumferential surface to increase a cooling effect on an opposite outer surface of the cooling plate.

8. An apparatus in accordance with claim 2, comprising, external heat shields provided on outer surfaces of the cooling plates for thermal insulation against the coating/heat-treatment.

9. An apparatus in accordance with claim 2, comprising, internal heat shields provided on horizontal inner surfaces of the cooling plates within the at least one internal cooling chamber for thermally insulating the cooling medium flowing through the cooling plates until such cooling medium enters the at least one internal cooling chamber.

10. An apparatus in accordance with claim 9, comprising, retainers for attaching the internal heat shields to the cooling plates, the retainers including guiding elements for guiding the cooling medium as it flows from the cooling plates into the at least one internal cooling chamber.

11. An apparatus in accordance with claim 1, comprising, internal heat shields provided on horizontal inner surfaces of the cooling plates within the at least one internal cooling chamber for thermally insulating the cooling medium flowing through the cooling plates until such cooling medium enters the at least one internal cooling chamber.

12. An apparatus in accordance with claim 11, comprising, retainers for attaching the internal heat shields to the cooling plates, the retainers including guiding elements for guiding the cooling medium as it flows from the cooling plates into the at least one internal cooling chamber.

13. An apparatus in accordance with claim 1, wherein the cooling plates comprise: an inner annular channel connected to a medium supply line, an intermediate annular channel, a volume control device positioned between the inner annular channel, an outer annular channel extending round an outer circumference of the cooling plates and curved swirler cooling medium channels connecting the intermediate annular channel and the outer annular channel extending on the outer circumference of the cooling plates.

14. An apparatus in accordance with claim 13, comprising, circumferentially distributed swirler nozzles connected to the outer annular channel to direct cooling medium to the supporting flanges and the blade platforms.

15. An apparatus in accordance with claim 13, wherein the volume control device comprises a first and a second setting ring, each provided with overlappable slotted ports such that the volume of cooling medium flow between the inner annular channel and the intermediate annular channel is controlled by the amount of overlap of the slotted ports.

* * * * *